US005271461A

United States Patent [19]

Decker et al.

[11] Patent Number: 5,271,461

[45] Date of Patent: Dec. 21, 1993

[54] COILED TUBING DEPLOYED INFLATABLE STIMULATION TOOL

[75] Inventors: Kenneth L. Decker; John H. Yonker, both of Carrollton, Tex.

[73] Assignee: Halliburton Company, Duncan, Okla.

[21] Appl. No.: 882,308

[22] Filed: May 13, 1992

[51] Int. Cl.[5] ..... E21B 33/127

[52] U.S. Cl. ..... 166/185; 166/187; 166/191

[58] Field of Search ..... 166/285, 387, 181, 185, 166/187, 186, 113

[56] References Cited

U.S. PATENT DOCUMENTS

| | | | |
|---|---|---|---|
| 2,611,437 | 9/1952 | Lynes | 166/10 |
| 4,424,860 | 1/1984 | McGill | 166/113 |
| 4,440,226 | 4/1984 | Suman, Jr. | 166/285 |
| 4,708,208 | 11/1987 | Halbardier | 166/387 |
| 4,711,301 | 12/1987 | Stringfellow | 166/187 |
| 4,776,396 | 10/1988 | Studholme | 166/187 |
| 4,865,131 | 9/1989 | Moore et al. | 166/387 |
| 4,928,759 | 5/1990 | Siegfried, II et al. | 166/65.1 |
| 4,951,747 | 8/1990 | Coronado | 166/387 |
| 5,020,592 | 6/1991 | Muller et al. | 166/187 |

OTHER PUBLICATIONS 1990-1991 *Composite Catalog of Oil Field Equipment and Services,* World Oil, Houston, Texas.

*Primary Examiner*—Ramon S. Britts
*Assistant Examiner*—Frank S. Tsay
*Attorney, Agent, or Firm*—Dennis T. Griggs; Mason C. Campbell; Tom Malorzo

[57] ABSTRACT

An inflatable stimulation tool designed to be deployed by coil tubing having a shuttle valve which reciprocates within the bore of a tubular mandrel. The shuttle valve, in cooperation with a reciprocally movable outer mandrel which is disposed about an inner mandrel, opens and closes various ports in the device to alternately seal and unseal the inflatable packer element. The shuttle valve also operates to open and close a flow passage through the inner mandrel to permit the passage of various stimulation fluids through the tool and into the well bore.

Upon deflation of the inflatable packing means, which leaves the packing means in a somewhat distended state, the element is urged to its original close relationship with the mandrel by a return spring which cooperates with the lower tool structure to which one end of the rubber packing element is clamped to longitudinally stretch the element.

39 Claims, 8 Drawing Sheets

COILED TUBING DEPLOYED INFLATABLE STIMULATION TOOL

FIELD OF THE INVENTION

This invention relates generally to inflatable packers used in well bores, and in particular to inflatable packers which may be deployed on coiled tubing and used for introducing stimulation fluids into one area of the well bore while isolating other areas of the well bore.

BACKGROUND OF THE INVENTION

Inflatable downhole tools are well known in the art and are used to perform a variety of tasks associated with completing and operating earth wells of various types, including oil, gas, water and environmental sampling and disposal wells.

Also, in the course of operating oil and gas wells, such wells may fail to sustain the same level of production as when they were first drilled because the face of the producing formation where it intersects the well bore has become fouled with debris or has become coated with a layer of insoluble mineral salts. When this occurs, it becomes necessary to rework the wells by placing stimulation fluids into the well bore to renew the face of the producing formation by dissolving the debris or mineral salts. When such stimulation work is performed, it is frequently desirable to isolate one producing zone from another and from other areas of the well bore to prevent the stimulation fluids from coming in contact with such other zones and such other areas of the well bore.

In order to introduce stimulation fluids into one area of a well bore while isolating other areas, a well bore packer must be employed as a part of the work string to accomplish such isolation. Also, since there are quite often several zones to be stimulated, it is desirable to be able to move the stimulation tool string up or down the well bore and to be able to unset, move and reset the packer several times to accomplish the stimulation work more efficiently.

In recent years it has become more economical to utilize coiled tubing to perform such stimulation jobs than to erect a workover rig and use other forms of conduits, such as jointed pipe, to perform the same function.

DESCRIPTION OF THE PRIOR ART

Inflatable packers which are designed to be set in open or uncased earth wells which often have irregular side walls, such as petroleum producing wells, or water wells, have been found desirable for many years. As a result, packers in which the sealing elements are designed to be hydraulically inflatable, and inflatable packers where the inflated sealing elements are designed to withstand high hydraulic pressures have become well known in the art. Also, inflatable tools which combine an inflatable sealing element with a device to either take in samples from a well bore or discharge stimulation fluids, such as acids, to a well bore are also known in the art. Additionally, it has become well known that inflatable packer elements tend to remain somewhat distended after deflation, often making retrieval of the packer difficult. To combat this undesirable tendency, prior art devices have had features added to aid in restoring the element to its original shape.

The chief limitations of these prior art devices which have become recognized and are sought to be overcome by this invention include unreliable sealing mechanisms which do not provide in all cases a positive seal between the tool string and the packer element to prevent undesired inflation or deflation of the packer element, and reliable means to restore the element, once deflated, to its original shape.

Another limitation is that many prior art devices have complex valve assemblies which are difficult to shift from one mode of operation to another. Also, when the tool is at a great depth in the well many prior art devices do not provide reliable signals to the operator at the surface that a shift in mode of operation has taken place within the tool.

Further limitations of these prior art designs which this invention seeks to overcome are: unreliable or difficult to operate valving mechanisms for shifting the tool between its various operations such as inflation and deflation of the element; equalization of the interior of the tool with the pressure of the well bore; shifting the tool to and from a fluid discharge or stimulation mode; and the general unavailability of repetitive setting mechanisms which enable multiple setting and unsetting of an inflatable tool in a single trip.

OBJECTS OF THE INVENTION

The principal object of this invention is to provide an improved inflatable well stimulation tool which can seal a cased or uncased, irregularly surfaced well bore.

A related object of the invention is to provide an improved inflatable well stimulation tool which can be run on coiled tubing.

A further related object of the invention is to provide an improved inflatable well stimulation tool which has reliable packer element sealing means.

Another related object of the invention is to provide an improved inflatable well stimulation tool which can be run in the well with the inflatable packer means sealed off from the other portions of the tool.

A still further object of the invention is to provide an improved inflatable well stimulation tool which can be easily shifted from one mode of operation to another.

Another related object of the invention is to provide an improved inflatable well stimulant tool which reliably and clearly signals the operator at the surface that the tool has shifted from one mode of operation to another.

A still further related object of the invention is to provide an inflatable well stimulation tool with means to stretch and elongate the inflatable packer means upon deflation to provide easy removal of the tool from the well bore.

Another related object of the invention is to provide a reliable mechanism to permit an inflatable element to be easily and reliably unset and reset several times in a single trip of the tool without the necessity of dropping activation or sealing means such as balls or darts down the tool string from the surface.

SUMMARY OF THE INVENTION

The foregoing objects are provided according to a preferred embodiment of the present invention by an inflatable stimulation tool having a shuttle valve which reciprocates within the bore of a tubular mandrel. The shuttle valve, in cooperation with a reciprocally movable outer mandrel which is disposed about an inner mandrel, opens and closes various ports in the device to alternately seal and unseal the inflatable packer element. The shuttle valve also operates to open and close a flow passage through the inner mandrel to permit the passage of various stimulation fluids through the tool and into the well bore.

Upon deflation of the inflatable packing means, which leaves the packing means in a somewhat distended state, the element is urged to its original close relationship with the mandrel by a return spring which cooperates with the lower tool structure to which one end of the rubber packing element is clamped to longitudinally stretch the element.

Operational features and advantages of the present invention will be understood by those skilled in the art upon reading the detailed description which follows with reference to the attached drawings.

DETAILED DESCRIPTION OF THE PREFERRED EMBODIMENT

Figure 1:
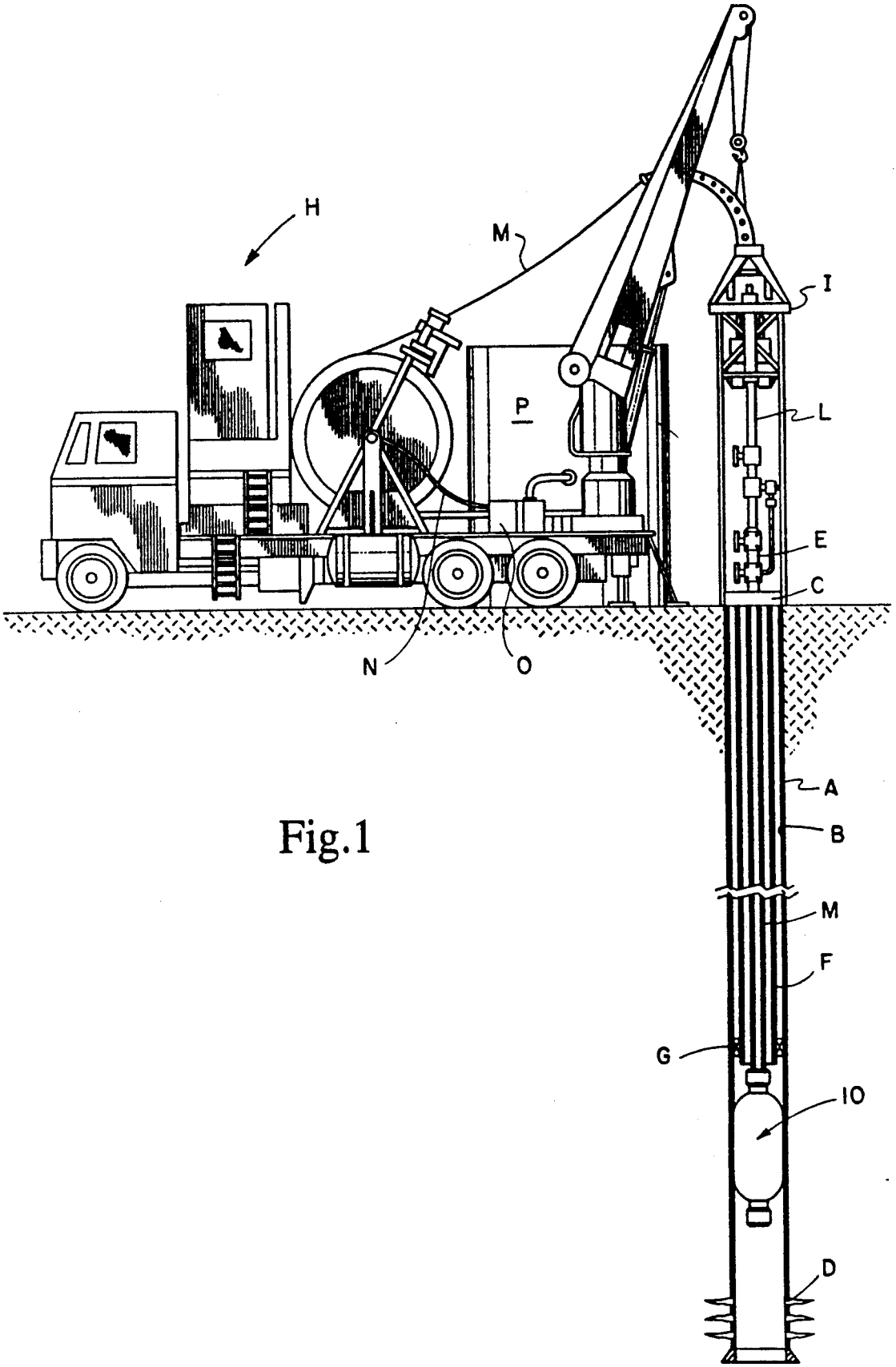
FIG. 1 is an elevational view, partially in section, of a coil tubing truck, coil tubing injector, well christmas tree and well bore with the invention in its expanded, stimulate mode.

In the description which follows, like parts are indicated throughout the specification and drawings with the same reference numerals, respectively. The drawings are not necessarily to scale and the proportions of certain parts may have been exaggerated to better illustrate the details of the invention. It is to be understood and is intended that this invention pertains to all possible orientations of well bores including vertical, deviated, highly deviated and horizontal, although it is shown only with respect to the vertical.

Referring now to FIG. 1, when an earth well is completed, a length of cementitious casing A extends for some length into well bore B from the well head C. The casing A has perforations D along its length adjacent to producing formations which are intersected by well bore B.

A Christmas Tree E is mounted on the well head C, from which a length of production tubing F extends for some distance into the casing and may even extend beyond the end of the casing A into an open, or uncased portion of the well bore B. Packing devices G are usually set at some point within the casing to seal the production tubing to the casing and function to channel fluids produced through perforations D to the surface through production tubing F.

Occasionally during the producing life of a well, the face of the producing formation adjacent the well bore or adjacent the perforations in the casing will become clogged with debris, such as fine sand or precipitated mineral salts, necessitating a well workover. To perform the well workover, a workover rig can be moved on to the well site to perform the workover. However, with the ready availability of more economical mobile coil tubing units, use of such coil tubing units is becoming the method of choice for performing well workovers. Such workovers are frequently called stimulation jobs.

As shown in FIG. 1, in order to perform the stimulation job using coil tubing, a coil tubing truck H is driven to the well site. A coil tubing injector I and, if well conditions dictate, a lubricator L is rigged up on the well. A connection is made to the Christmas Tree E to allow a continuous length of coil tubing M, to which the stimulation tool 10 is attached, to be fed into the production tubing F.

The coil tubing M is connected by hose means N to a pump 0 and reservoir P which contains the stimulation fluids. Fluids such as acids and/or surfactants are usually selected to clean the obstructed face of the well bore thereby both restoring the face to a permeability level approximating its original permeability and restoring the well's production to a level approximating production levels when the well was first brought on production.

Within the coil tubing truck H are instruments such as pressure monitors and flow rate indicators, not shown, comprising either digital or analog gauges connected to sensors, also not shown, to indicate the pressure and rate of flow of the stimulation fluids through the coil tubing M.

Figure 2:
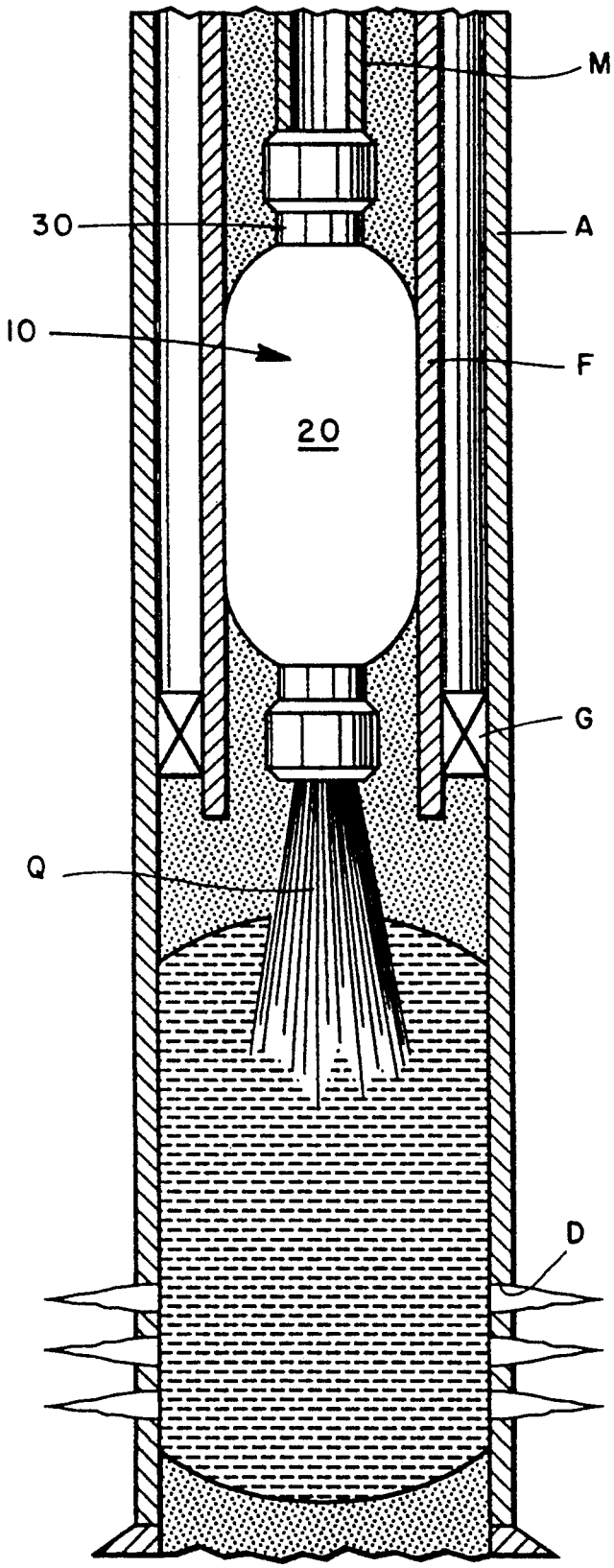
FIG. 2 is an exploded sectional view of the inflatable stimulation tool located and expanded in a well bore with the tool discharging fluids as in the stimulation mode.

As shown in FIG. 2, the stimulation tool 10 includes an inner mandrel 30 with a flow path therethrough which is attached to coil tubing M and has inflatable packer element 20 sealingly disposed thereon. Once inflatable packer element 20 is inflated into cooperative sealing engagement with the production tubing F, as shown in FIG. 2, stimulation fluids Q are discharged through the flow path in the tool into contact with the face of the producing formation.

Figure 4A:
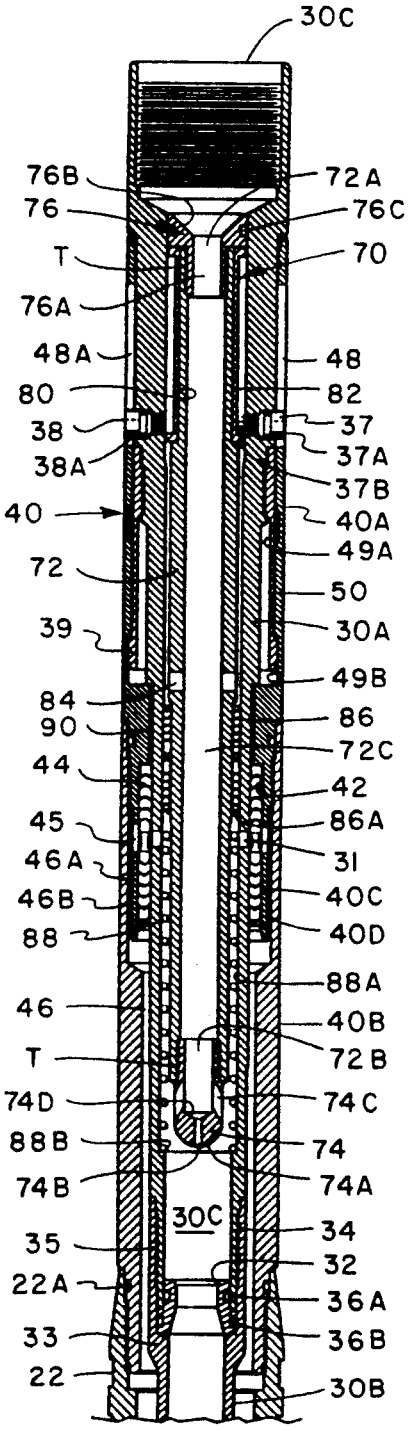
FIGS. 4A through 4C are sectional views of the stimulation tool.
Figure 4B:
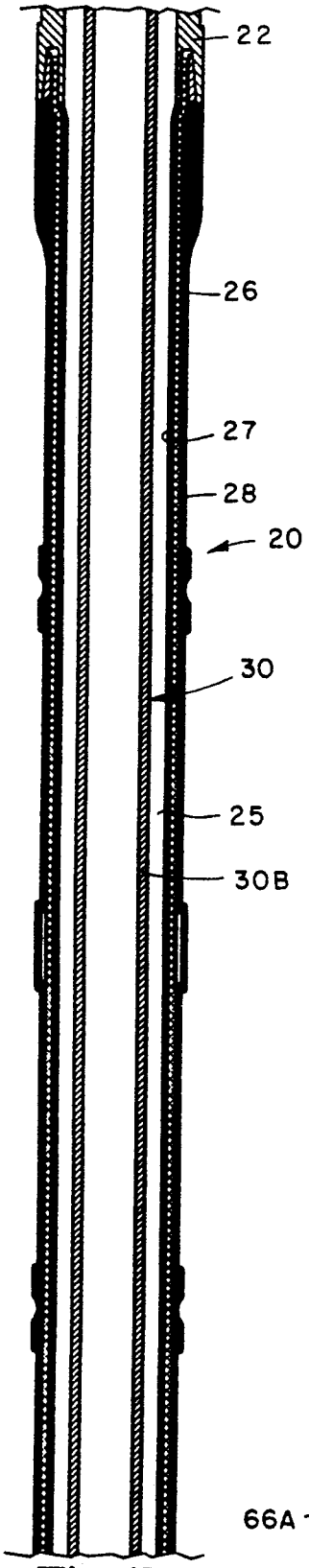
Figure 4C:
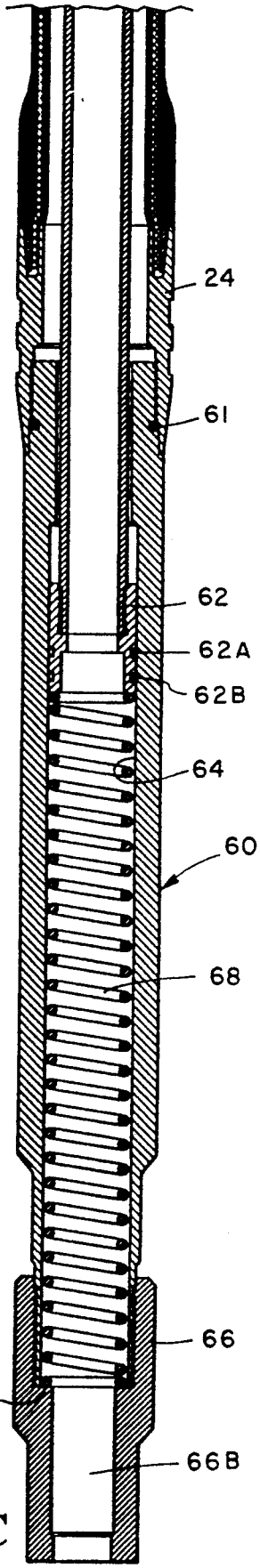

Referring now to FIGS. 4A through 4C, the stimulation tool 10 can be generally described as having a long, cylindrical shape with a longitudinal flow passageway extending therethrough. An inner mandrel 30, described below, and an inflatable packer element means 20 are two of the principal components of the stimulation tool 10. Other components, which are concentrically aligned with and slidably connected to the inner mandrel 30, include an upper outer mandrel 40, comprising an upper mandrel 40A threadedly connected to a top sub 40B, and a lower mandrel 60.

The inflatable packer element 20 may be any commercially available element, such as that shown on the CT TM resettable packer sold by TAM International which is presented on page 3318 of the 1990–1991 *Composite Catalog of Oil Field Equipment and Services*, published by World Oil, Houston, Tex.

Such inflatable packer means typically comprise a layer of reinforcement material 26, such as metal braid either alone or together with a weave of cord. The cord may be either all natural fibers, all man-made fibers or a mixture of natural and man-made fibers. This reinforcement material is sandwiched between and bonded to an inner rubber bladder 27 which is compounded to provide fluid retention and to an outer rubber covering 28 which is compounded and designed to resist scuffing and tearing. The inner rubber bladder 27 and the outer rubber covering 28 may be of the same or different composition.

The upper end shoe 22 and the lower end shoe 24 are fixedly and sealingly attached to inflatable packer means 20. The upper end shoe 22 is threadedly attached to top sub 40B, described below, and sealed against leakage by o-ring 22A.

The lower end shoe 24 is threadedly and sealingly attached to the lower mandrel 60, described below, and cooperates with the upper end shoe 22 to dispose and retain the inflatable packer means 20 in position about the inner mandrel 30.

The tubular inner mandrel 30, which extends the entire length of inflatable packer means 20, has a longitudinal flow bore 30C therethrough and comprises a tubular upper seal mandrel 30A threadedly connected to a tubular lower inner mandrel 30B so that the flow bores of the upper seal mandrel 30A and the lower inner mandrel 30B are in flow registration with one another. One end of the upper seal mandrel 30A extends through the upper outer mandrel 40, described below, and provides means for attaching the stimulation tool 10 to a coiled tubing string M or to any other desired running tool, such as jointed pipe or the like.

A valve seat 32 is placed on a radially outwardly stepped shoulder 33 at the upper end of lower inner mandrel 30B. The valve seat 32 is retained in place on the stepped shoulder 33 by the cooperative engagement of box connector 34 which is formed distal to said shoulder with pin connector 35 of upper seal mandrel 30A. The valve seat 32 is sealed against fluid leakage by dual o-ring seals 36A, 36B. Radial flow ports 31 intersect the wall of the inner mandrel 30 intermediate the valve seat 32 and the threaded attachment point for collets 39, described below, to provide flow communication between the flow bore of the inner mandrel 30C and the exterior thereof.

Threadedly inserted into the upper seal mandrel 30A proximate a cylindrical indexing collar 82, described below, is at least one dual function travel limiting and guide slot lug 37 and at least one single function travel limiting lug 38. Each lug has an extended length head, 37A and 38A, respectively which is fitted with an o-ring seal, not shown, to prevent fluid leakage therearound. Additionally, the dual function travel limiting and guide slot lug 37 has a pin end 37B formed adjacent the threaded portion thereof which extends into flow bore 30C.

A collar with a plurality of radially outwardly extended resilient collet fingers 39, hereinafter referred to as collets, depending therefrom is threadedly attached to the exterior of the upper seal mandrel 30A. When the tool is run into the hole, the collets 39 extend into cooperative engagement with lower detent 49B, described below.

Figure 5:
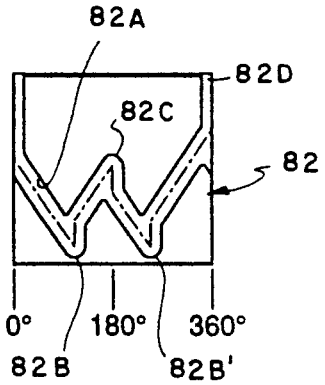
FIG. 5 is a perspective view of the continuous J - slot on the velocity valve of the invention.

The combination travel limiting and guide slot lug **37*a* has pin end 37B which extends beyond the inner wall of the upper seal mandrel 30A into engagement with the continuous J - slot 82A, shown in FIG. 5, which is on indexing collar 82. The single function travel limiting lug 38 has no such pin end and its threaded portion is sized not to extend beyond the inner surface of the wall of upper mandrel 30A. Extended length heads 37A, 38A extend beyond the exterior surface of upper seal mandrel 30A into cooperative engagement with travel limiting slots 48, 48A, which are longitudinally oriented slots cut through the upper mandrel 40A. The cooperative engagement of the lug heads and the travel limiting slots limit the distance of longitudinal travel of the inner mandrel 30 relative to the upper outer mandrel 40**.

A pair of parallel annular grooves are circumferentially cut into the interior wall of the upper mandrel 40A forming an upper detent 49A and a lower detent 49B on either side of a circumferential ring 50 which is formed on the interior surface of the mandrel as a result of cutting the circumferential grooves.

Intermediate the lower end of the lower detent 49B and the lower end of the upper mandrel 40A, an annular groove 42 is cut into the inner circumference of the mandrel thereby forming an indentation into which the upper element seals 44 are secured. Resistant backing for the element seals 44 is provided by the interior wall of upper mandrel seal extension 40C.

The lower mandrel 60 is slidably disposed about the lower end of the lower inner mandrel 30B and retained thereon by the lower element seal assembly 62. The lower element seal assembly 62 is threadedly attached to the lower end of the lower inner mandrel 30B. Dual o-ring seals 62A, 62B slidably engage the polished inner bore 64 which traverses the entire length of lower mandrel 60 providing flow passage therethrough. A spring retainer 66, which also functions as a fluid discharge nozzle threadedly attaches to the lower end of the lower mandrel 60. The spring retainer 66 has a radially inwardly stepped shoulder 66A which engages the lower end of the element return spring 68 to retain the spring in the tool. The upper end of the spring 68 is retained by the lower end of the lower element seal assembly 62. The return spring 68 is in cooperative engagement with the lower element seal assembly 62 and the spring retainer 66. A fluid flow passage 66B through the spring retainer 66 provides communication for fluid flow between interior of the stimulation tool 10 and the well bore B. 0-Ring 61, which sealingly engages end shoe 24 as aforesaid is positioned in a groove about the external surface of lower mandrel 60 proximate the attachment point for said lower shoe.

A shuttle valve 70 is slidingly and sealingly positioned within the flow bore of the upper seal mandrel 30A and biased toward one end of the upper seal mandrel 30A by return spring 88. The shuttle valve 70 is sometimes referred to as a velocity valve.

The shuttle valve 70 comprises a cylindrical shuttle valve mandrel 72 which has an inlet 72A at one end thereof, an outlet 72B at the other end thereof and flow bore 72C connecting the inlet and the outlet. A discharge nozzle 74, described below, is threadedly connected by threads T to the outlet 72B. The external surface of the shuttle valve mandrel 72 has an annular groove 80 milled into its surface adjacent the inlet 72A. The groove 80 receives the cylindrical indexing collar 82, and maintains the collar in rotating engagement with the shuttle valve mandrel 72.

The discharge nozzle 74 has a smooth polished exterior sealing surface 74A for sealing the nozzle in valve seat 32 and an internal generally hemispherical cross section 74D at its distal end.

A hydrostatic bleed port 74B in the distal end of the discharge nozzle 74 and a plurality of radially outwardly sloping flow ports 74C are spaced about the circumference of discharge nozzle 74. These ports provide flow communication between the outlet of flow bore 72C and the interior of the upper seal mandrel 30A.

Threadedly and sealingly connected to the inlet 72A by threads T and o-ring 76C which is retained in an external circumferential groove is a cylindrically shaped collar lock 76 which has a flow bore 76A therethrough in flow registration with flow bore 72C of the shuttle valve. The collar lock flow bore 76A has an inlet formed by a radially inwardly sloping shoulder 76B. The collar lock 76 both retains the cylindrical indexing collar 82 in position on the exterior of the valve mandrel 72 and functions as a trash barrier to prevent well debris from lodging in the channel of the continuous J - slot 82A, shown in FIG. 5, which would inhibit the intended operation of the inflatable stimulation tool 10.

Radial inflation ports 84 intersect the shuttle valve mandrel 72 intermediate the ends of the mandrel to establish flow communication between the longitudinal flow bore 72C and the exterior of valve mandrel 72. Stacked equalizing port seals 86 are disposed about the exterior of the shuttle valve 70 intermediate the inflation ports 84 and the return spring 88. The return spring 88 is located in a spring housing 88A which is formed by a radially outwardly stepped shoulder 88B, located intermediate the valve seat 32 in inner mandrel 30 and the lower seal retainer 86A. The lower seal retainer 86A forms the upper boundary of spring housing 88A and serves as a spring stop for the return spring 88.

The stimulation tool 10 is run into the hole with the inner mandrel 30 maintained in position by the engagement of the collets 39 with the lower detent 49B. The collets 39 are sized so that appreciable longitudinal force must be applied to the inner mandrel 30 to collapse the collets and move the inner mandrel 30 relative to the upper outer mandrel 40 either from a first lower position to a second upper position or from the second upper position to the first lower position.

When the inflatable packer means 20 is inflated into contacting engagement with either the casing A or the well bore B, the upper outer mandrel 40 becomes fixedly engaged with the well bore B as a result of the frictional forces between the inflated packer means 20 and the face of the well bore. Once the inflatable packer means 20 is so engaged, it is possible to pull up on the coil tubing M by means of the coil tubing injector I thereby moving the inner mandrel 30 longitudinally upward with reference to the upper outer mandrel 40. This movement causes the collets 39 to deflect inwardly to pass over ring 50 until they arrive at and expand into the upper detent 49A, thereby securing the inner mandrel 30 against inadvertent downward movement relative to the upper outer mandrel 40.

The upper outer mandrel 40 comprises an upper mandrel 40A threadedly and sealingly attached to a top sub 40B proximate the element seals 44. Upper seal mandrel extension 40C of the upper mandrel 40A and top sub extension 40D of the top sub 40B overlap each other when the upper mandrel 40A and the top sub 40B are threadedly connected. These unthreaded extensions are sized so that a spaced relationship is maintained between the two extensions thereby forming inflation passage 46.

The inflation passage 46 extends from port 45 which intersects upper seal mandrel extension 40C intermediate the upper element seals 44 to an annular space 25 which is formed by the spaced relationship maintained between the inflatable packer element 20 and the inner mandrel 30.

Figure 10A:
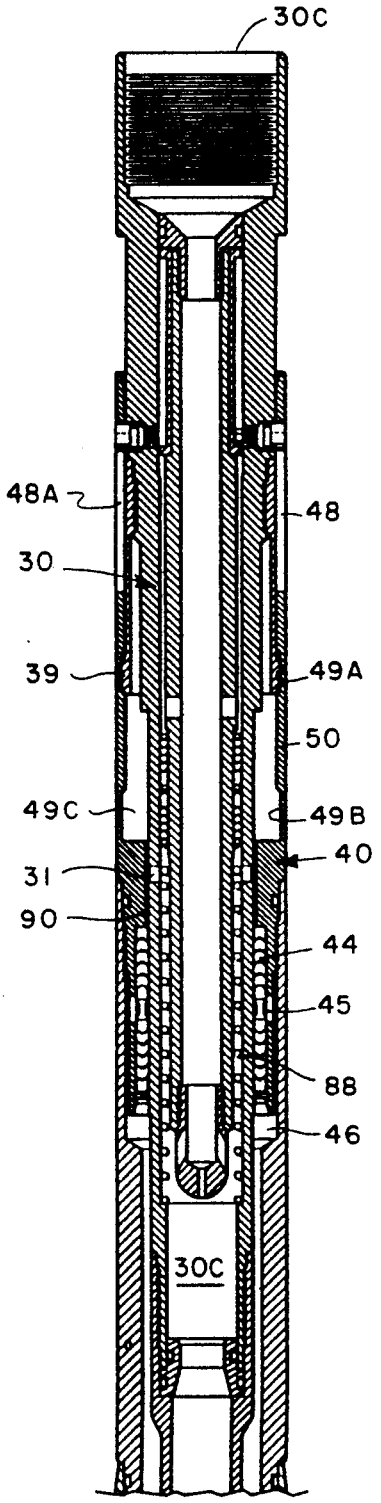
FIGS. 10A through 10C are sectional views of the stimulation tool showing the velocity valve in its first position, the element inflated, and the inflation ports closed.

Referring now to FIG. 10A, the stimulation tool 10 is provided with an equalization passage to facilitate the equalization of pressures within stimulation tool 10 with those in the well bore B. This equalization is accomplished as a result of fluid leakage through port 31 into equalization passage 90 and thence into annular space 49C. Annular space 49C is positioned in such manner to provide a locally enlarged inner radius in upper outer mandrel 40 in which collets 39 are free to flex. From the annular space 49C, fluid then flows around the collets 39 and ultimately into well bore B through travel limiting slots 48, 48A.

METHOD OF OPERATION

When the stimulation tool 10 is run in the well bore, the inflatable packer means, which is in cooperative engagement with the lower mandrel 60, will be maintained in close spatial relationship with the inner mandrel 30 by the force of the element return spring 68, as is shown in FIG. 4B and 4C. This close spatial relationship minimizes the volume of the annular space 25 on run in. The element return spring 68, which is in cooperative engagement with the lower mandrel 60 and with the lower element seal assembly 62, acts upon the lower mandrel to urge it into a first extended position relative to the upper outer mandrel 40.

The stimulation tool 10 is run in the well by the coacting engagement of the coil tubing M with the coil tubing injector I which is controlled by the operator in the coil tubing truck H.

Figure 6:
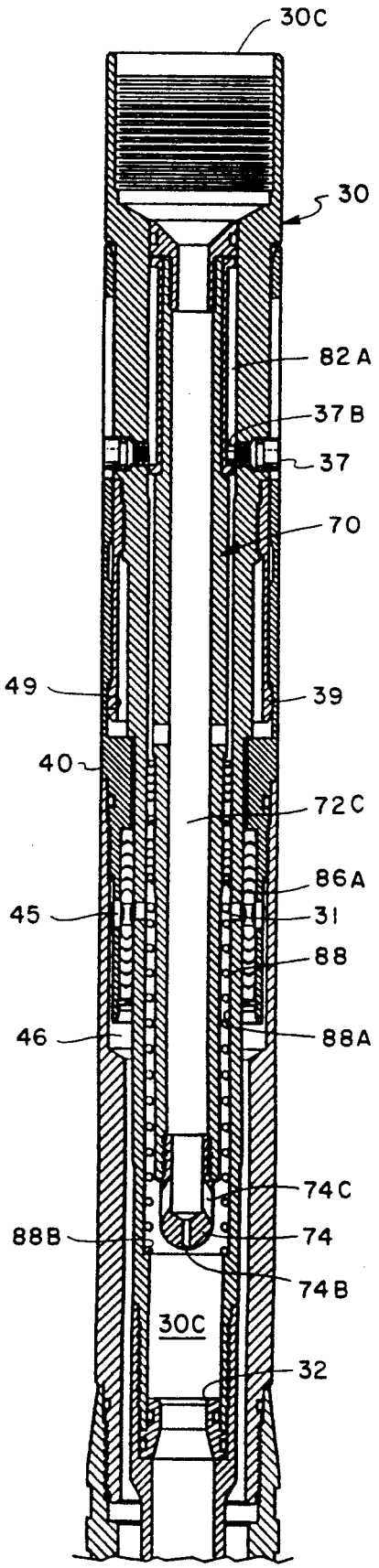
FIG. 6 is a sectional view of the upper portion of the stimulation tool with the velocity valve in its first, upper position and the outer mandrel inflation ports open (the low flow run - in position).

Referring now to FIG. 6, on run in, the shuttle valve 70 will be maintained in a first upper position within the inner mandrel 30 by the force exerted by return spring 88 coacting with the radially inwardly stepped shoulder 88B of spring housing 88A against the lower seal retainer 86A. The correct valve position is maintained by the cooperative engagement of pin 37B which extends from the dual function travel limiting and slot guide lug 37, and J - slot 82A to maintain pin 37B at location 82B, shown in FIG. 5. In this position, the discharge nozzle 74 is maintained within the boundaries of the spring housing 88A and remote from the valve seat 32.

The inner mandrel 30 is maintained in its first, lower position relative to the upper outer mandrel 40 by the engagement of the collets 39 with the lower detent 49B. In this first, lower position, the inner mandrel flow port 31 is in flow registration with the outer mandrel port 45. While the flow registration of flow port 31 with port 45 opens and establishes further flow communication with the inflation passage 46 and the annular space 25, the inflatable packer means 20 does not inflate, because, fluid will be pumped by pump 0 from reservoir P at the well surface, as shown in FIG. 1 through coil tubing M and through stimulation tool 10 at a low flow rate, for example five gallons or less per minute. The relatively small volume of pumped fluid is generally sufficient to prevent the ingestion of well fluids or debris into the interior of the tool, but it is not sufficient to inflate the packer means 20.

In the configuration described above and shown in FIG. 6, pumped fluid flows through the flow bore 72C of the shuttle valve 70 and out of the valve through the radial flow ports 74C and through the hydrostatic bleed port 74B in discharge nozzle 74. The pumped fluid then flows out of the tool through flow bore 30C in inner mandrel 30 and through spring retainer 66.

In the more normal condition or in the event debris is encountered within well bore B which inhibits or prevents the introduction of the stimulation tool 10 into the well bore to the desired depth, the flow rate of the pumped fluid can be increased, for example, to 15 or more gallons per minute. This higher flow rate is usually sufficient to wash the debris from the well bore thereby allowing the stimulation tool 10 to be placed at the desired depth. Of course, it is understood that when the flow rate is increased as aforesaid, the pressure exerted by the pumped fluid within the coil tubing M and within the stimulation tool 10 will also increase proportionately, as for example to 500 psi. For purposes of illustration, and not by limitation, 500 psi will be referred to as the "reference pressure" to provide a basis upon which flow measurements hereinafter mentioned will be predicated.

When fluid is pumped into stimulation tool 10 at an increased flow rate, the increased flow and pressure will create a longitudinally downward velocity driven force component which will react with the radially inwardly sloping shoulder 76B of the collar lock 76 and with hemispherical cross section 74D of the discharge nozzle 74. This longitudinal force component both causes the cylindrical indexing collar 82 to rotate about the circumference of the shuttle valve 70 and applies sufficient force to return spring 88 to overcome the force exerted by the return spring 88, thereby moving shuttle valve 70 to its second, or intermediate position.

Figure 7:
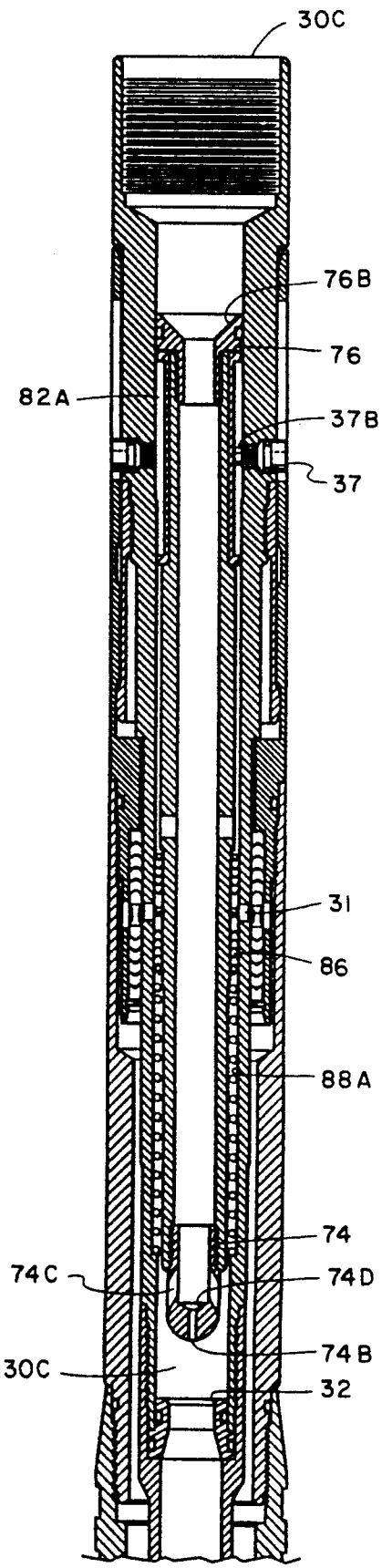
FIG. 7 is a sectional view of the upper portion of the stimulation tool with the velocity valve in its second, intermediate position and the outer mandrel inflation ports open (the high flow run - in position).

Referring now to FIG. 7, in this second, intermediate position, pin 37B of the combination travel limiting and slot guide lug 37 is located at position 82C of continuous J - slot 82A, as shown in FIG. 5. This second intermediate position also causes the radial flow ports 74C in the velocity valve discharge nozzle 74 to be positioned in the flow bore 30C of the inner mandrel 30 thereby allowing unrestricted flow of fluids from the tool to the well bore B through the path described above. Also, in this second position, the stacked equalizing port seals 86 are positioned across the inner mandrel flow port 31 thereby isolating the inflatable packer means 20 from the increased pressures and flows within the stimulation tool 10. In this position, it is possible to pump fluids through the inner mandrel 20 at any desired rate or pressure with the pumped fluid exiting stimulation tool 10 through spring retainer 66 without inflating the inflatable packer element 20.

Once the stimulation tool 10 is located at the desired position in the well bore B, as determined by measurement apparatus on the coil tubing truck H at the surface, the operator stops movement of the coil tubing M through the injector I. If the low flow rate described above has been used while the stimulation tool 10 was injected into the well bore B to the desired depth, the pump speed is increased to increase fluid pressure in coil tubing M to the reference pressure. At the reference pressure, the flow rate and pressure through the coil tubing M is sufficient to cycle the shuttle valve 70 to the second intermediate position.

The design of shuttle valve is such that a relatively low fluid velocity, as for example the velocity produced at a flow of 10 gallons per minute will generate sufficient force against radially inwardly sloping shoulder 76B of collar lock 76 and against hemispherical cross section 74D of discharge nozzle 74 to cycle the shuttle valve 70 to its intermediate second position. When the movement of the shuttle valve 70 to the intermediate position has occurred, the operator first notes the pressure and fluid flow rate as signalled on the instruments in the coil tubing truck, then, the pump output is isolated from the flow path which decreases both the fluid pressure and the fluid velocity reacting on the shuttle valve 70.

When the fluid pressure and flow rate is decreased, the fluid velocity reacting with the radially inwardly sloping shoulder 76B of the collar lock 76 and with the hemispherical cross section 74D of the discharge nozzle is also decreased. This decrease in fluid velocity reduces the longitudinally downward force component, described above, which is coacting with these surfaces to force the velocity valve 70 into one of its lower positions.

As shown in FIGS. 4 through 9, the velocity valve 70 can be cycled into three different positions: (1) a first upper position, in which pin 37B of lug 37 is located at either position 82B or 82 B' in J - Slot 82A, as shown in FIG. 5; (2) a second intermediate position in which pin 37B is located at position 82C; or (3) a third lower position in which pin 37B is located at position 82D.

J - Slot 82A is constructed so that velocity valve 70 must return to its first position before it can be cycled from its second position to its third position. Likewise the valve must move to its first position before it can be cycled from its third position to its second position.

Once the downward force component is less than the force exerted by the return spring 88, the return spring force causes the cylindrical indexing collar to rotate about shuttle valve mandrel 72, and the shuttle valve 70 is urged upwardly into its first upper position shown in FIG. 6. As the velocity valve 70 moves upwardly to its first position, pin 37B of lug 37 moves to position 82B', shown in FIG. 5.

When it is desired to begin the stimulation job, fluids are pumped from the reservoir P through the coil tubing M to the stimulation tool 10. Fluid Q, delivered by pump 0 on the coil tubing truck H, is once again pumped at a relatively high flow rate as, for example 15 gallons or more per minute. As the flow rate is once again increased, fluid velocity is also increased as aforesaid. This increase in fluid velocity once again increases longitudinally downward forces acting on the velocity valve 70 overcoming the force exerted by the return spring 88 thereby both causing continuous J - slot 82A to rotate about the external surface of shuttle valve mandrel 72 and urging shuttle valve 70 to move longitudinally within the mandrel 30 to its third, lowermost position. In this position, pin 37B moves to position 82D of continuous J - slot 82A, as shown in FIG. 5.

Figure 8:
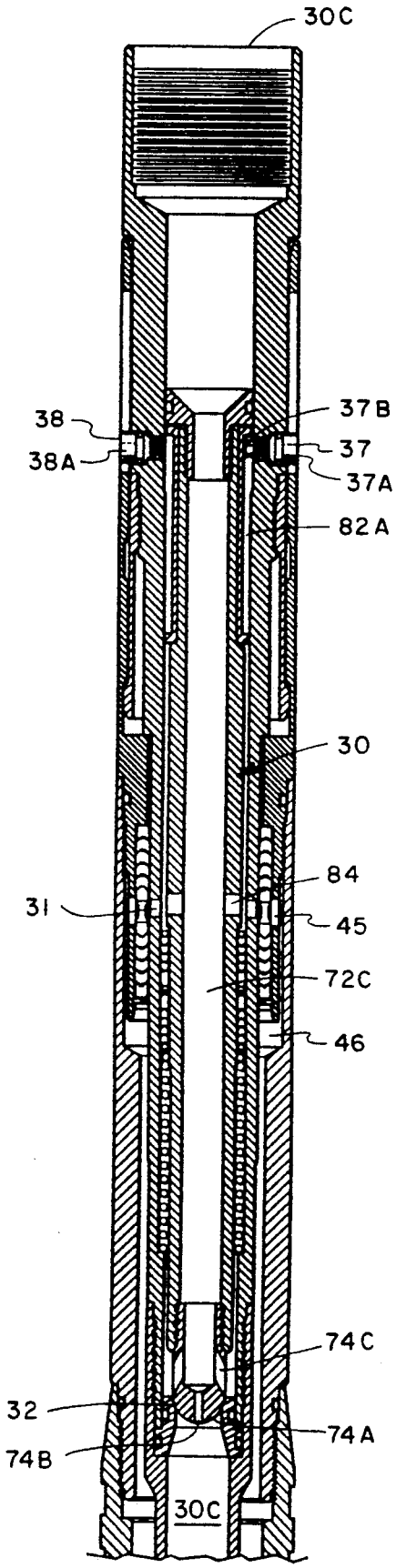
FIG. 8 is a sectional view of the upper portion of the stimulation tool with the velocity valve in its third, lowermost portion and the outer mandrel inflation ports open (the inflation position).

Referring now to FIG. 8, in this third, lowermost position, the shuttle valve 70 has moved longitudinally downward within the inner mandrel 30 so that the smooth polished sealing surface 74A of discharge nozzle 74 is in sealing engagement with valve seat 32. This sealing engagement isolates flow ports 74C from communication with the flow passage 30C of inner mandrel 30. Also, this third position of shuttle valve 70 places radial inflation port 84, which intersects shuttle valve mandrel 72 into flow registration with both flow port 31 in the inner mandrel 30 and with port 45 in the upper outer mandrel 40. The alignment of the three ports operates to flowingly connect the annular space 25 between the inner mandrel 30 and the inflatable packer means 20 with the flow bore 72C of shuttle valve 70 by means of inflation passage 46. Since hydrostatic bleed port 74 is of minimal size and radial flow ports 74C are sealingly isolated from flow bore 30C of inner mandrel 30, substantially all of the fluid pumped down coil tubing M is directed to annular space 25 to effect the inflation of inflatable packer means 20.

As inflatable packer means 20 inflates, its overall length decreases proportionately. As the length decreases lower mandrel 60 is pulled upwardly from its first position to a second position which is more central to the tool. This upward motion compresses and charges element return spring 68, which is engaged by lower element seal assembly 62 and spring retainer 66.

Figure 10B:
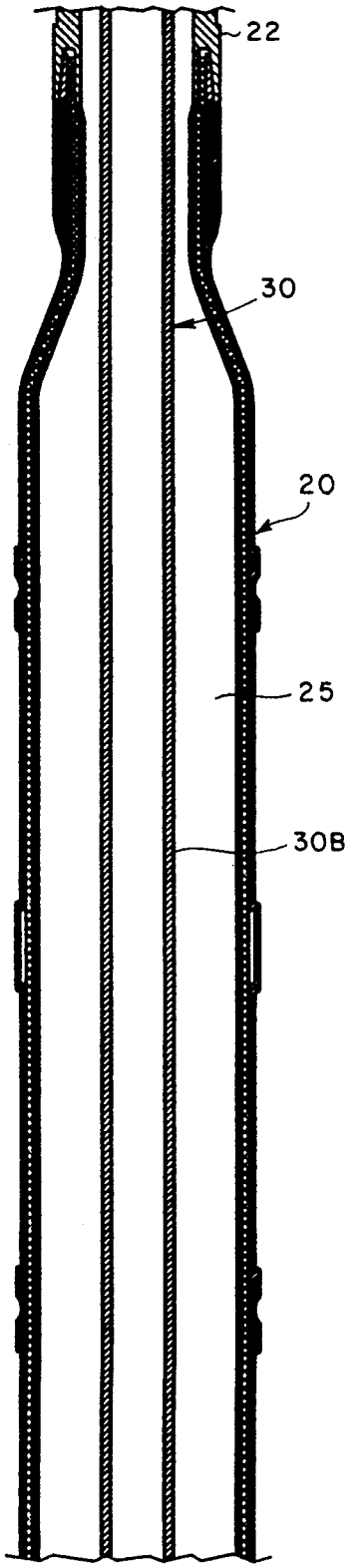
Figure 10C:
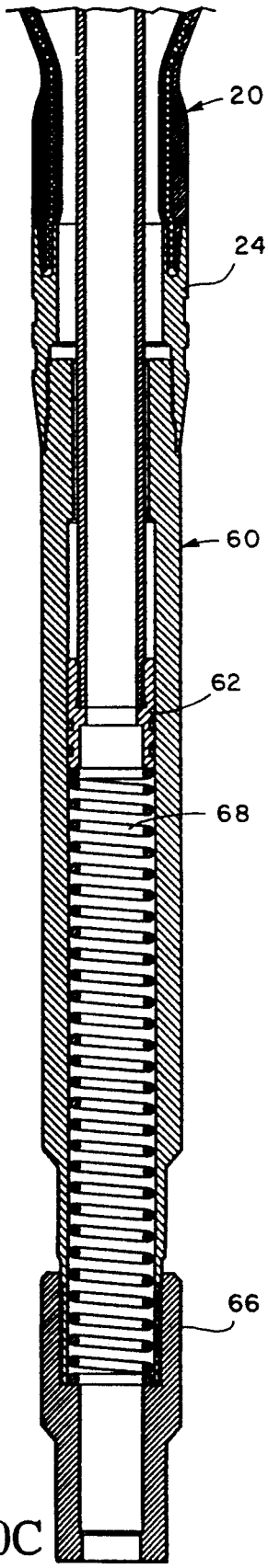

Referring now to FIGS. 10A, 10B and 10C, with pump 0 operating at sufficient speed to generate the reference pressure, when inflatable packer means 20 is inflated into contacting and sealing engagement with well bore B, not shown, this engagement is signaled to the operator at the surface by both a rise in pressure within the coil tubing M and by a decrease in flow rate, for example to 10 gallons per minute or less. When the operator receives the engagement signal, he causes the coil tubing M to be pulled upwardly by injector I thereby moving the inner mandrel 30 longitudinally upward with reference to the upper outer mandrel 40 from its first lower position to its second upper position.

As the inner mandrel 30 is pulled upwardly, the collets 39 are collapsed inwardly to pass over ring 50 and move from the lower detent 49B to the upper detent 49A. This relative motion of the inner mandrel 30 to the upper outer mandrel 40 signals the operator that the inflatable packer means 20 has inflated into contact with well bore B by an increase in weight as shown on the weight indicator in the coil tubing truck H. The relative motion of the mandrels also moves flow port 31 from flow registration with port 45 and into flow registration with equalization passage 90. In addition, this movement also interposes the upper element seals 44 between port 31 and port 45 thereby sealingly isolating inflation passage 46 from the flow bore 30C of inner mandrel 30 and flow bore 72C of the shuttle valve 70 to prevent undesired deflation of inflatable packer means 20. Also, because shuttle valve 70 is in its third, or lowest, position when inflatable packer means 20 is being inflated, as shown in FIG. 8, the relative movement of the mandrels also places radial equalizing ports 84 of shuttle valve 70 into flow registration with equalizing passage 90.

When equalizing ports 84 are placed into flow registration with equalizing passage 90 as aforesaid, a flow passage is established between the inner bore 30C of inner mandrel 30 and the annulus between the exterior of coil tubing M and the interior of production tubing F. As soon as this occurs, a rapid dump of internal pressure within the coil tubing M occurs, which is signaled to the operator at the surface. This signal informs the operator that the inflation cycle has been successfully completed.

After the aforesaid pressure dump occurs, pump O is isolated from the flow path and the fluid velocity is decreased within the stimulation tool 10. As the force of return spring 88 again becomes sufficient to overcome the velocity of the fluid flowing through stimulation tool 10, the velocity valve 70 returns to its first position.

It must be noted that drag force must be applied to the upper outer mandrel 40 before inner mandrel 30 can be moved relative thereto. Therefore, the inflatable packer means 30 can only be sealed against deflation after it has first been inflated, since the inflated packer means 30 supplies the required drag force as a result of its contacting engagement with the well bore.

Once inflatable packer means 20 has been sealed and pressures within coil tubing M have once again returned to a low steady state, indicating that velocity valve is in its first position, the stimulation tool 10 is in condition to commence the stimulation job.

Pump O is reinserted into the flow path and stimulation fluids Q are introduced into the coil tubing M once again increasing the fluid flow rate through the coil tubing.

Figure 9:
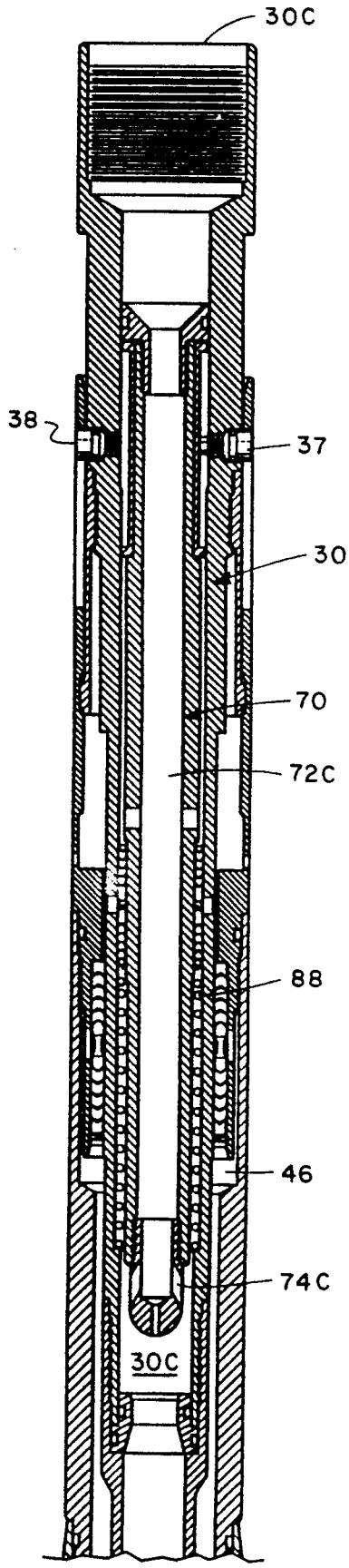
FIG. 9 is a sectional view of the upper portion of the stimulation tool, with the velocity valve in its second position and the outer mandrel inflation ports sealed (the stimulation position).

Referring now to FIG. 9, when fluid velocities increase sufficiently to overcome the force of return spring, velocity valve 70 moves to its second position as aforesaid. This second position places radial flow ports 74C in flow registration with the flow bore 30C of inner mandrel 30. Since inflation passage 46 is sealingly isolated from flow bore 30C and from flow bore 72C of shuttle valve 70, substantially all of the stimulation fluids Q are pumped through the coil tubing M into flow bore 72C of the shuttle valve 70. From flow bore 72C, the stimulation fluid Q then flows through radial flow ports 74C out of the shuttle valve 70, through inner mandrel flow bore 30C and out of the stimulation tool 10 into the well bore as shown in FIG. 2. That the shuttle valve 70 is in the second mandrel position, sometimes referred to as the stimulation position, is signaled to the operator by a higher rate of flow at the pump reference pressure than when the valve 70 is in the first position.

After the stimulation work has been completed, pump pressure is once again reduced, thereby allowing velocity valve 70 to return to its first position. As shown in FIGS. 10A, 10B and 10C in this configuration, flow registration is established between flow bore 30C of inner mandrel 30 and the exterior of the tool above the inflated packer means 20 by means of flow port 31 and equalization passage 90 through annular space 49C. Since flow bore 30C is in communication with the well bore below the inflated element and annular space 49C is in communication with the well bore above the inflated element, pressures in the well bore become equalized on either side of the tool.

Referring once again to FIG. 4, the operator then applies weight to the coiled tubing M by means of the coiled tubing injector I to shift the inner mandrel 30 from its second position longitudinally downward with respect to upper outer mandrel 40 to its first position. This action restores flow registration between inner mandrel port 31, upper outer mandrel port 45 and inflation passage 46 which, under low pressure conditions, allows inflatable packer means 20 to deflate. As inflatable packer means 20 deflates, its diameter decreases and its overall length correspondingly increases. When the length increases, charged return spring 68 exerts a downward force on the lower mandrel 60 moving the lower mandrel from its second position back to its first position which is remote from upper mandrel 40. As the lower mandrel 60 moves to its first position, the inflatable packer means 20 is urged to resume the close spatial relationship with inner mandrel 30 which it had on run in.

The deflation of inflatable packer means 20 is signaled to the operator on the surface as an increase in weight on the weight indicator which is caused by the stimulation tool 10 becoming disengaged from the wall of the well bore B and hanging freely on the end of coil tubing M. Substantially complete deflation of inflatable packer means 20 is signaled to the operator by a return of internal coil tubing pressure to a low steady state. When the inflatable packer means 20 has fully deflated, the stimulation tool 20 is in condition to either be moved to another location in well bore B to repeat the stimulation operation or to be retrieved from the well.

ALTERNATIVE EMBODIMENT

Figure 3A:
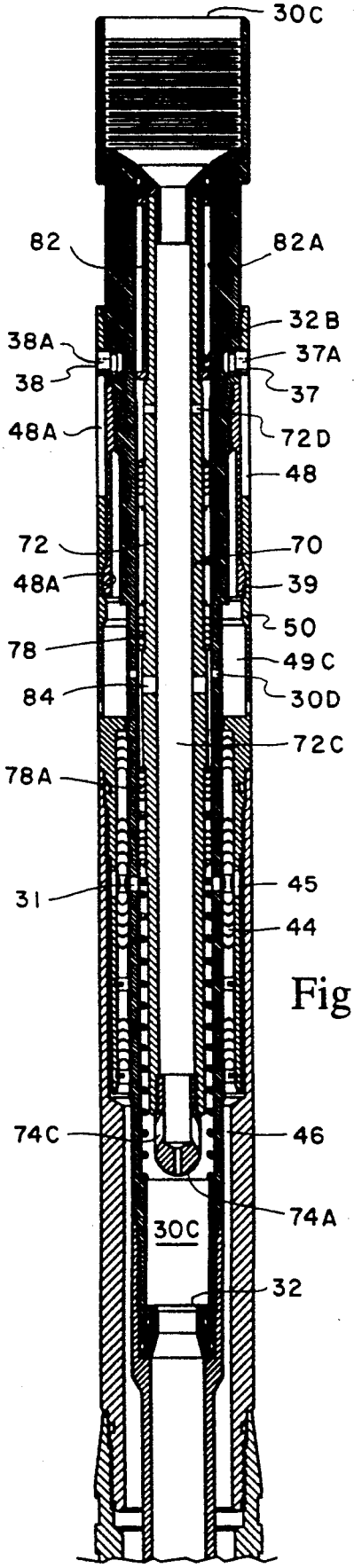
FIGS. 3A through 3C are sectional views of an alternative embodiment of the stimulation tool.
Figure 3B:
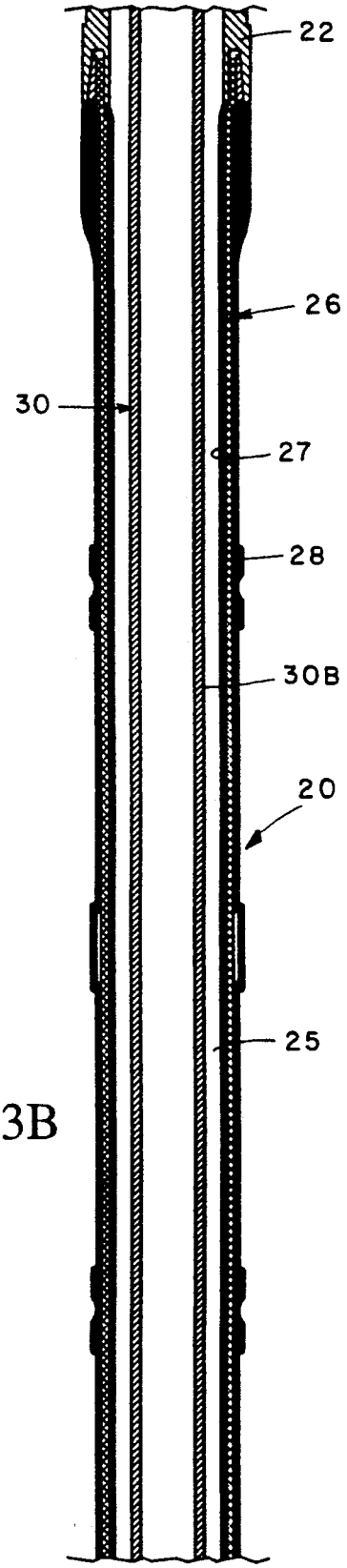
Figure 3C:
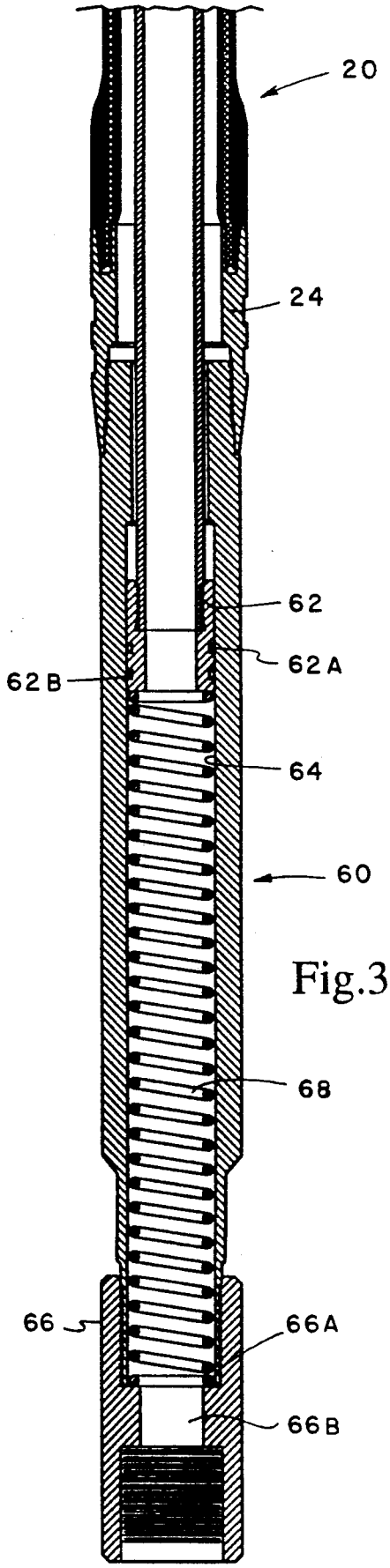

Referring now to FIGS. 3A, 3B and 3C, in an alternative embodiment, the tool can be run with the collets 39 on inner mandrel 30 positioned in the upper detent 49A. To seal the inflatable packer means 20 after it has been inflated, this embodiment requires that the operator set down weight on the coiled tubing M to collapse the collets 39 and allow them to pass over the ring 50 into the lower detent 49B. This action removes the inner mandrel port 31 from flow registration with the outer mandrel port 45. It also interposes the upper element seals 44 between port 31 and port 45, thereby sealingly removing the inflation passage 46 from flow registration with both the inner mandrel flow bore 30C and the shuttle valve flow bore 72C. As in the preferred embodiment, this sealing of the inflation passage also seals inflatable packer element 20 against inadvertent deflation.

In this embodiment, the velocity valve 70 has radial equalizing ports 72D which intersect the shuttle valve mandrel 72 and provide flow communication between the velocity valve flow bore 72C and the inner mandrel flow bore 30C. The shuttle valve mandrel 72 is also intersected by radial the inflation ports 84.

The inner mandrel 30 has a pair of equalizing ports 30D which provide flow communication between the flow bore of the inner mandrel 30C and annular space 49C. When the alternative embodiment is in the equalization position shown in FIG. 3A, fluid is permitted to flow from the flow bore 72C through the radial inflation ports 84 and the radial flow port 74C, as well as from the flow bore 30C, through the equalizing ports 30D into annular space 49C. From annular space 49C, fluid then flows around the collet 39 and through the travel limiting slots 48, 48 A into the well bore B.

In order to avoid the unintentional bleeding of internal pressure to the exterior of the tool during either the inflation or the stimulation cycles, as shown in FIG. 3A, velocity valve 70 has a pair of stacked equalizing port seals 78, 78A mounted in spatial relationship to each other and disposed about the external circumference of shuttle valve mandrel 72 on either side of the radial inflation port 84.

When the velocity valve 70 is cycled to the inflation position, wherein the velocity valve is in its third position and the smooth polished sealing surface 74A of discharge nozzle 74 is in sealing engagement with the valve seat 32, the inner mandrel port 31, port 45 and inflation port 84 are in flow registration with each other. This flow registration establishes communication between the inner mandrel flow bore 30C through the inflation passage 46 and the annular space 25. In this alternative embodiment, the pair of equalizing port seals 78, 78A are positioned so that the radial inflation port B4 is intermediate the two seals and thereby isolated from the various flow paths within the tool. All other structures, functions and positions of the various tool components previously described, except those described in this section are equivalent to those in the Preferred Embodiment described above.

Although the invention has been described with reference to an oil well completion, and with reference to a particular preferred embodiment, the foregoing description is not intended to be construed in a limiting sense. Various modifications of the disclosed embodiment as well as alternative applications, for example, use as a straddle packer and/or use in water wells or environmental wells, will be suggested to persons skilled in the art by the foregoing specification and illustrations. It is therefore contemplated that the appended claims will cover any such modifications or embodiments that fall within the true scope of the invention.

What is claimed is:

1. A well stimulation tool for running into a well on tubular running means comprising:

a. an inner mandrel with a longitudinal flow bore extending therethrough;

b. means for attaching the inner mandrel to a tubular running means to allow fluid communication between the running means and the flow bore;

c. an outer mandrel slidably carried on the exterior of the inner mandrel;

d. inflatable packing means surrounding said inner mandrel and attached to said outer mandrel;

e. port means extending through the inner mandrel to communicate fluid between the longitudinal flow bore and the inflatable packing means;

f. a shuttle valve carried within the inner mandrel, said shuttle valve being movable to a first position which allows fluid flow through the longitudinal flow bore with fluid pressure not retained in the inflatable packing means, to a second position which restricts fluid flow through the port means and communicates fluid flow through the longitudinal flow bore of the inner mandrel and fluid is restricted from entering the inflatable packing means, and to a third position which blocks fluid flow through the flow bore and communicates fluid flow through the port means to inflate the inflatable packing means;

g. means for shifting the shuttle valve from its first position to its second position in response to changes in fluid flow through the longitudinal flow bore;

h. means for shifting the shuttle valve from its first position to its third position in response to changes in fluid flow through the longitudinal flow bore; and i. means for shifting the inner mandrel relative to the outer mandrel independent of the position of the shuttle valve therein in response to tension applied from the tubular running means.

2. The well stimulation tool of claim 1 further comprising a valve seat disposed about the inner circumference of the longitudinal flow bore.

3. The well stimulation tool of claim 1 further comprising valve control means disposed about the exterior of the shuttle valve.

4. The well stimulation tool of claim 2 wherein the shuttle valve is sealingly engageable with the valve seat in the third position.

5. The well stimulation tool of claim 1, including seal means disposed between said inner mandrel and said outer mandrel.

6. The well stimulation tool of claim 5 wherein said seal means are disposed to sealingly isolate said inner mandrel port means from said inner mandrel longitudinal bore, 7. The well stimulation tool of claim 1 wherein the exterior surface of the inner mandrel is in sealing engagement with the interior surface of the outer mandrel.

8. The well stimulation tool of claim 1 comprising indexing means for controlling movement of the outer mandrel relative to the inner mandrel.

9. A well test tool for use with a tubing string to communicate stimulation fluids to select downhole locations in a well bore comprising:

a. a tubular mandrel for attaching the well tool to the tubing string;

b. a longitudinal bore extending through the tubular mandrel to communicate stimulation fluids from the tubing string to a selected downhole location;

c. an inflatable sealing element carried on the exterior of the well tool to form a fluid barrier with the interior of the well bore at the selected downhole location; and, d. means for inflating the sealing element in response to changes in fluid velocity through the longitudinal bore, said inflating means including a velocity valve slidably disposed within the longitudinal bore, said velocity valve being moveable to a first position which allows fluid communication between the longitudinal bore and the well bore and movable to a second position which restricts fluid communication with the well bore and allows fluid communication between the longitudinal bore and the interior of the sealing element.

10. A well test tool as defined in claim 9 further comprising a spring coupled to said sealing element and said tubular mandrel for restoring the sealing element to its original shape after undergoing inflation and deflation in response to changes in fluid flow rate through the longitudinal bore.

11. A well test tool as defined in claim 10 further comprising means for preventing the sealing of inflation passages prior to inflating the sealing element.

12. A well test tool as defined in claim 10 further comprising means for preventing the premature inflation of the sealing element.

13. A well test tool as defined in claim 10 further comprising means to selectively prevent the sealing element from undesired deflation.

14. A well test tool as defined in claim 9 further comprising:

a. means for releasably holding the velocity valve in its first position until the change in fluid flow rate through the longitudinal bore exceeds a preselected value; and b. means for releasably holding the velocity valve in its second position until the change in fluid flow rate through the longitudinal bore decreases below a preselected value.

15. An inflatable stimulation tool for applying stimulation fluids to a well bore comprising a tubular mandrel having a flow bore attachable to a length of tubing and having inflatable packer means sealingly engaged with and disposed thereabout, said length of tubing being adapted to convey fluids at elevated pressures, said tool including valve means responsive to changes in fluid pressure for opening and closing flow ports so that the following operations may be performed during a single trip:

a. wash the tool into the well bore to a desired depth without prematurely inflating said packer means;

b. inflate the inflatable packer means to isolate one portion of the well bore from other portions of the well bore;

c. equalize pressures in the well bore above and below the tool;

d. apply stimulation fluids to the well bore without deflating said packer means;

e. deflate said packer means thereby permitting further movement of the tool within the well bore; and, f. reinflate said packer means at another location within the well bore.

16. The inflatable stimulation tool set forth in claim 15 further comprising means responsive to change in tension applied to said length of tubing to seal said inflatable packer means against deflation.

17. The inflatable stimulation tool set forth in claim 16 wherein said valve has seal means disposed about the exterior circumference thereof.

18. The inflatable stimulation tool of claim 15 comprising a velocity valve disposed within the bore of said tubular mandrel.

19. The inflatable stimulation tool of claim 15 wherein said tubular mandrel further comprises a longitudinal flow bore therethrough and a valve seat disposed within said longitudinal flow bore intermediate the ends of said mandrel.

20. The inflatable stimulation tool of claim 15 wherein said length of tubing comprises coiled tubing.

21. The inflatable stimulation tool of claim 15 wherein said length of tubing comprises jointed pipe.

22. A resettable inflatable packer which is resistant to premature inflation comprising, in combination:

a tubular inner mandrel having an inlet and an outlet with a flow passage therebetween, a valve seat positioned in said flow passage intermediate the inlet and the outlet, a flow port intermediate the inlet and the outlet extending through the wall of the mandrel providing a fluid passage between the flow bore and the exterior of the mandrel, and means for attaching the mandrel to a tubular work string;

a shuttle valve having an exterior sealing surface and being slidingly positioned within and sealingly engaged with the inner wall of the flow passage of the inner mandrel intermediate the valve seat and the inlet thereto, the position of the shuttle valve being slidingly responsive to changes in fluid velocity;

a tubular upper outer mandrel concentrically disposed about the exterior of the inner mandrel thereby defining an annular space therebetween; said outer mandrel being selectively positionable with respect to the inner mandrel and including means to sealingly attach one end of an inflatable packer element thereto, said upper outer mandrel being intersected by a flow port thereby connecting the interior of the inner mandrel into fluid communication with said annular space formed between the inner mandrel and the inflatable packer means;

a tubular lower outer mandrel positioned remotely from the upper outer mandrel and concentrically disposed about and sealingly engaged with the lower end of the inner mandrel, the lower outer mandrel being biased by spring means to a first extended position relative to the upper outer mandrel and slidable to a second contracted position relative to the upper outer mandrel, and having means to sealingly attach inflatable packer means thereto; and inflatable packer means sealingly attached to the upper outer mandrel and to the lower outer mandrel and being concentrically disposed about the inner mandrel thereby forming said annular space between the inner mandrel and the packer means.

23. The resettable inflatable packer of claim 22 wherein the tubular inner mandrel further comprises a first motion retarding means threadedly attached to the exterior thereof.

24. The resettable inflatable packer of claim 23 wherein said first motion retarding means comprises a collet assembly having resilient collet fingers depending therefrom.

25. The resettable inflatable packer of claim 22 wherein the upper outer mandrel has a bore surface which is intersected by first and second parallel annular grooves thereby defining a ring intermediate said grooves, said annular grooves forming a detent on either side of said ring.

26. The resettable inflatable packer of claim 23 wherein said first motion retarding means comprises a collet having fingers in cooperative engagement with said detents.

27. The resettable inflatable packer of claim 23 wherein said first motion retarding means are adapted to yieldingly oppose movement of the inner mandrel relative to the outer mandrel.

28. The resettable inflatable packer of claim 22 wherein said tubular inner mandrel further comprises a second motion retarding means threadedly attached to and protruding radially outwardly from the exterior surface thereof.

29. The resettable inflatable packer of claim 28 wherein said second motion retarding means comprises lugs extending radially outwardly from said tubular inner mandrel.

30. The resettable inflatable packer of claim 29 wherein said lugs cooperate with slots in said outer mandrel to restrict the range of longitudinal motion thereof.

31. The resettable inflatable packer of claim 22 wherein the shuttle valve comprises a tubular mandrel having a flow bore therethrough connecting an inlet to an outlet.

32. The resettable inflatable packer of claim 31 wherein said inlet has an annular collar which is intersected by a longitudinal flow bore threadedly connected thereto.

33. The resettable inflatable packer of claim 32 wherein said longitudinal flow bore of said annular collar has a radially inwardly sloping inlet thereto.

34. The resettable inflatable packer of claim 31 wherein said outlet to said tubular mandrel has a discharge nozzle threadedly connected thereto, said discharge nozzle being radially intersected by outwardly sloping flow ports.

35. The resettable inflatable packer of claim 34 wherein said discharge nozzle further comprises a smooth sealing surface on the exterior thereof.

36. The resettable inflatable packer of claim 22 wherein said shuttle valve is selectively moveable from a first upper position, to a second intermediate position and to a third lower position.

37. The resettable inflatable packer of claim 36 wherein said shuttle valve has means to prevent movement from said second position to said third position without reentering said first position.

38. The resettable inflatable packer of claim 31 wherein said shuttle valve has sealing means attached to the exterior surface thereof.

39. A well stimulation tool for running into a well bore on tubular running means comprising, in combination:

an inner mandrel having a longitudinal flow bore extending therethrough;

means for attaching the inner mandrel to a tubular running means to allow fluid communication between the running means and the longitudinal flow bore;

an outer mandrel slidably carried on the exterior of the inner mandrel;

inflatable packing means surrounding said inner mandrel and attached to said outer mandrel;

port means extending through the inner mandrel for communicating fluid between the longitudinal flow bore and the inflatable packing means;

a flow velocity valve carried within the inner mandrel, said flow velocity valve being movable in response to fluid flow through the inner mandrel to a first position which restricts fluid flow through the port means and communicates fluid flow through the longitudinal flow bore of the inner mandrel and fluid is restricted from entering the inflatable packing means, and to a second position which restricts fluid flow through the longitudinal flow bore and communicates fluid flow through the port means to inflate the inflatable packing means; and, bias means coupled to said velocity valve for urging said velocity for movement to the first position.

* * * * *